US008932160B1

(12) United States Patent
Turner et al.

(10) Patent No.: US 8,932,160 B1
(45) Date of Patent: Jan. 13, 2015

(54) OBLONG THROWING BALL WITH CENTRAL PASSAGE

(71) Applicants: Dallas Turner, Tallahassee, FL (US); Jeffrey Mitchell, Tallahassee, FL (US)

(72) Inventors: Dallas Turner, Tallahassee, FL (US); Jeffrey Mitchell, Tallahassee, FL (US)

( * ) Notice: Subject to any disclaimer, the term of this patent is extended or adjusted under 35 U.S.C. 154(b) by 85 days.

(21) Appl. No.: 13/927,172

(22) Filed: Jun. 26, 2013

(51) Int. Cl.
*A63B 43/00* (2006.01)
*A63B 37/02* (2006.01)

(52) U.S. Cl.
CPC ..... *A63B 37/02* (2013.01)
USPC ..... 473/613

(58) Field of Classification Search
USPC ..... 473/613, 596, 595, 597; D21/712, 707; 446/61
See application file for complete search history.

(56) References Cited

U.S. PATENT DOCUMENTS

| | | | | | |
|---|---|---|---|---|---|
| 3,884,466 | A | * | 5/1975 | MacDonald et al. | 473/613 |
| 4,003,574 | A | * | 1/1977 | MacDonald et al. | 473/613 |
| 4,736,948 | A | * | 4/1988 | Thomas | 473/613 |
| 4,925,195 | A | * | 5/1990 | Di Manno | 473/613 |
| 5,000,451 | A | * | 3/1991 | MacDonald et al. | 473/594 |
| 5,123,645 | A | * | 6/1992 | MacDonald et al. | 473/594 |
| 5,152,709 | A | * | 10/1992 | Johnson et al. | 446/71 |
| 5,306,191 | A | * | 4/1994 | Phillips et al. | 446/61 |
| 5,397,261 | A | * | 3/1995 | Malewicki et al. | 446/71 |
| 5,458,329 | A | * | 10/1995 | Bushman et al. | 473/613 |
| 5,460,368 | A | * | 10/1995 | Pearson | 473/613 |
| D386,229 | S | * | 11/1997 | Hicks | D21/712 |
| 5,833,897 | A | * | 11/1998 | Grimm | 264/46.5 |
| 6,045,469 | A | * | 4/2000 | Gleason et al. | 473/613 |
| 6,220,918 | B1 | * | 4/2001 | Laronge | 446/63 |
| D639,360 | S | * | 6/2011 | Lederman et al. | D21/712 |
| D657,011 | S | * | 4/2012 | Lederman et al. | D21/712 |
| 8,403,778 | B2 | * | 3/2013 | Wallach et al. | 473/613 |
| 2012/0289369 | A1 | * | 11/2012 | Fogarty | 473/613 |

* cited by examiner

*Primary Examiner* — Steven Wong
(74) *Attorney, Agent, or Firm* — J. Wiley Horton

(57) ABSTRACT

A throwable ball having a large internal passage aligned with its central axis. An insert defines the bounds of the internal passage. This insert is surrounded by compressible foam that gives the ball an easy gripping surface. Interlock features are preferably provided between the insert and the compressible foam so that they do not slip relative to each other.

20 Claims, 6 Drawing Sheets

OBLONG THROWING BALL WITH CENTRAL PASSAGE

BACKGROUND OF THE INVENTION

1. Field of the Invention

This invention relates to the field of sports. More specifically, the invention comprises an oblong throwing ball containing a large central passage that is bounded by a rigid material, with the outer portions of the ball being made of compressible foam.

2. Description of the Related Art

Spherical balls have been used in many sports and many amusement games. An example is the pressurized spherical ball used in the international game of football (known in America and some other regions as "soccer"). A spherical ball obviously rolls well and is easy to kick and otherwise manipulate with the feet. However, it is not easy to throw a large spherical ball.

The game of American football initially used a pressurized ball having an oblong shape. The original American football was similar in size and shape to the ball presently used in the sport of Rugby. However, as the forward pass evolved in American football during the first half of the $20^{th}$ century, the ball began to change as well. The ball evolved to include distinct point at each end and a more slender shape. This allowed the ball to be more easily gripped and thrown.

The modern American football has a distinct central axis, with points at each end lying along this central axis. A skilled passer can release the ball so that (1) the ball's central axis is parallel to its flight path, and (2) the ball's center of rotation coincides with its central axis. When these two conditions exist, the passer has achieved a "tight spiral." When the two conditions do not exist, the ball appears to "flutter." This is true primarily because the leading point of the ball does not lie on the axis of rotation. Instead, it rotates around the axis of rotation, This eccentricity of rotation tends to persist throughout the flight of the ball. It significantly increases drag and also reduces directional stability. A badly eccentric throw is often called a "wounded duck." For the same amount of initial velocity, it will not travel nearly as far as a "tight spiral."

Thus, significant skill is required to correctly throw a modern American football. The exterior surface of such a football is also relatively rigid and requires a strong grip to throw effectively. It would be advantageous to provide a football having a more compressible exterior surface that could be more easily gripped. It would also be advantageous to provide a football having eccentricity-correcting features so that the ball would tend to stabilize in flight even when thrown poorly. The present invention provides these features as well as additional features.

BRIEF SUMMARY OF THE PRESENT INVENTION

The present invention comprises a throwable ball having a large internal passage aligned with its central axis. A relatively rigid insert defines the bounds of the internal passage. This insert is surrounded by compressible foam that gives the ball an easy gripping surface. Interlock features are preferably provided between the insert and the compressible foam so that they do not slip relative to each other.

The diameter of the internal passage is large in comparison to the overall diameter of the ball. The diameter of the internal passage is preferably at least 50% of the overall diameter. Although the insert extends for most of the length of the ball, it does not extend to the two ends. The ends only contain the compressible foam. This prevents injury or damage when the ball strikes something.

Figure 1:
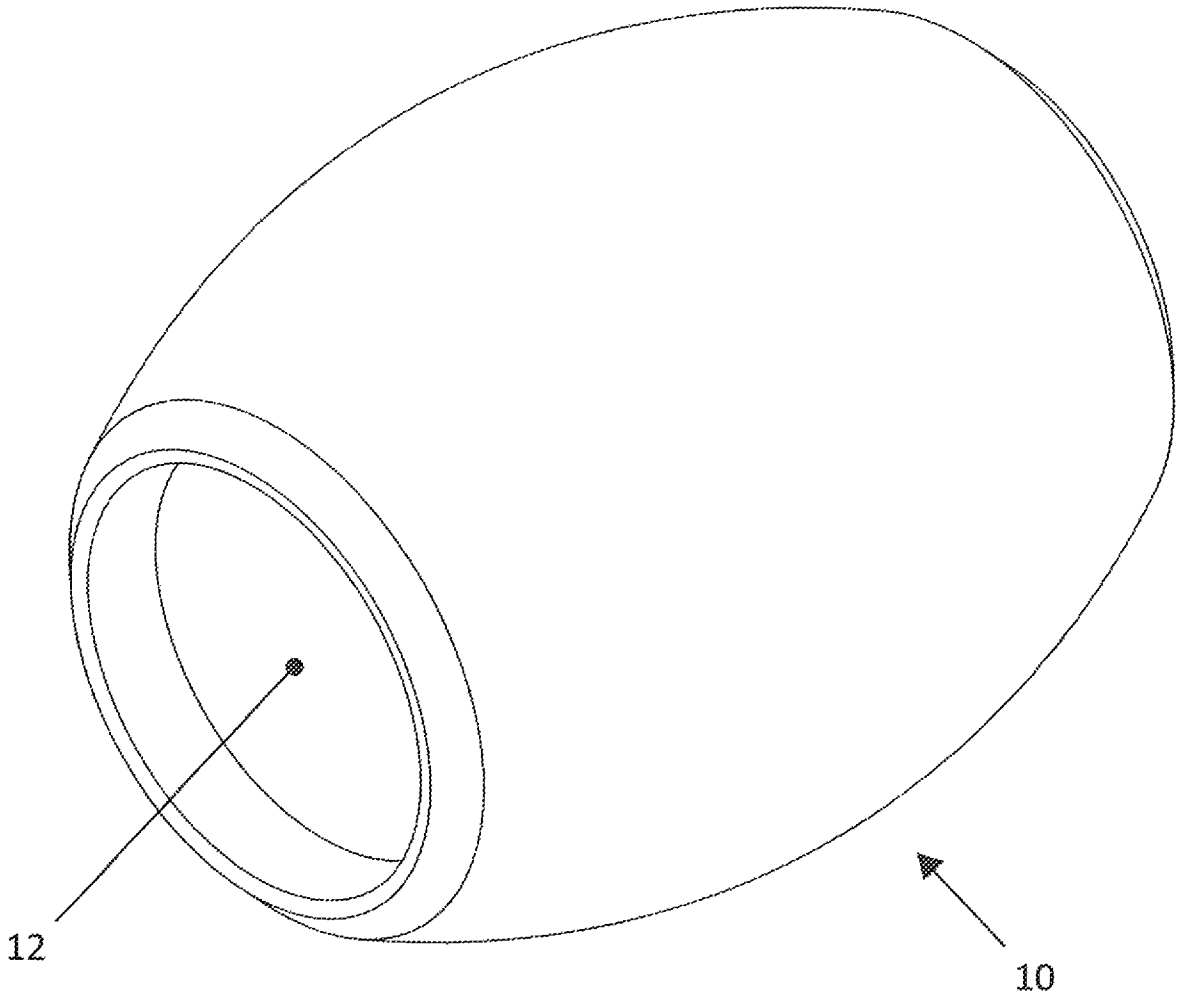
FIG. 1 is a perspective view, showing the inventive ball in an assembled state.

| REFERENCE NUMERALS IN THE DRAWINGS | |
|---|---|
| 10 orb ball | 12 central passage |
| 14 insert | 16 rib |
| 20 insert containment step | 22 central axis |
| 26 air flow | 28 foam body |
| 30 passage diameter | 32 overall diameter |
| 34 first end | 36 second end |
| 38 exterior profile | 40 first insert end |
| 42 second insert end | 44 chamfer |
| 46 fillet | 48 compression region |
| 50 insert recess | 52 insert passage |
| 54 foam body passage | |

DETAILED DESCRIPTION OF THE INVENTION

FIG. 1 shows a perspective view of the present invention, designated as orb ball 10. The orb ball has an outward facing surface that is generally similar to the surface of an American football. it also includes central passage 12 a cavity running completely through the ball along its central axis. The orb ball includes two major components that are locked together. A relatively rigid insert forms the "core" of the ball. This insert is surrounded by pliable, high-density foam.

Figure 2:
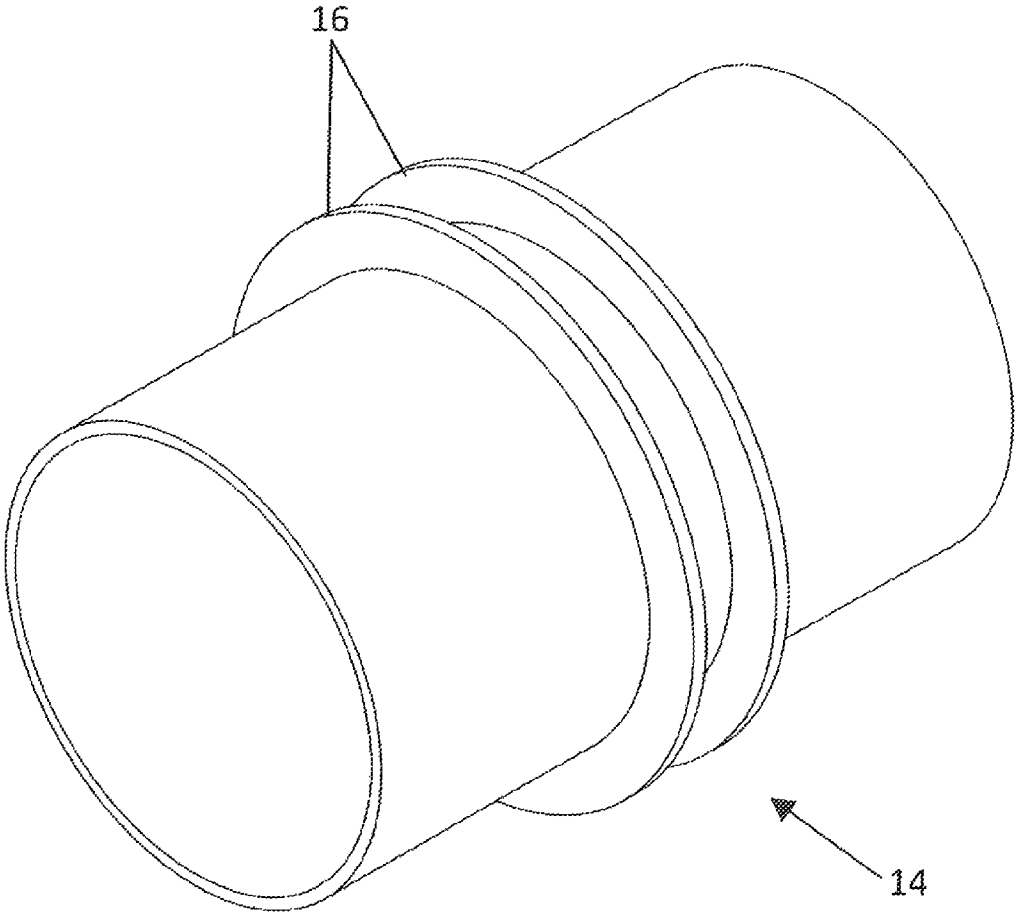
FIG. 2 is a perspective view, showing the insert alone.

FIG. 2 shows a perspective view of insert 14 by itself. Insert 14 includes a cylindrical side wall defining a hollow internal passage. In the completed assembly it is surrounded by the high-density foam. The insert is preferably made from a relatively rigid material, such as an injection molded thermoplastic. The term "relatively rigid" refers to the relative rigidity of the insert with respect to the surrounding foam.

It is preferable to provide one or more interlocking features that will help lock the insert and the surrounding foam together. In the embodiment shown a pair of ribs 16 extend radially outward from the cylindrical wall. The foam is typically molded around the insert so the foam—while still in a non-set state—flows around the ribs. When the foam sets, the ribs create a mechanical interlock.

Figure 3:
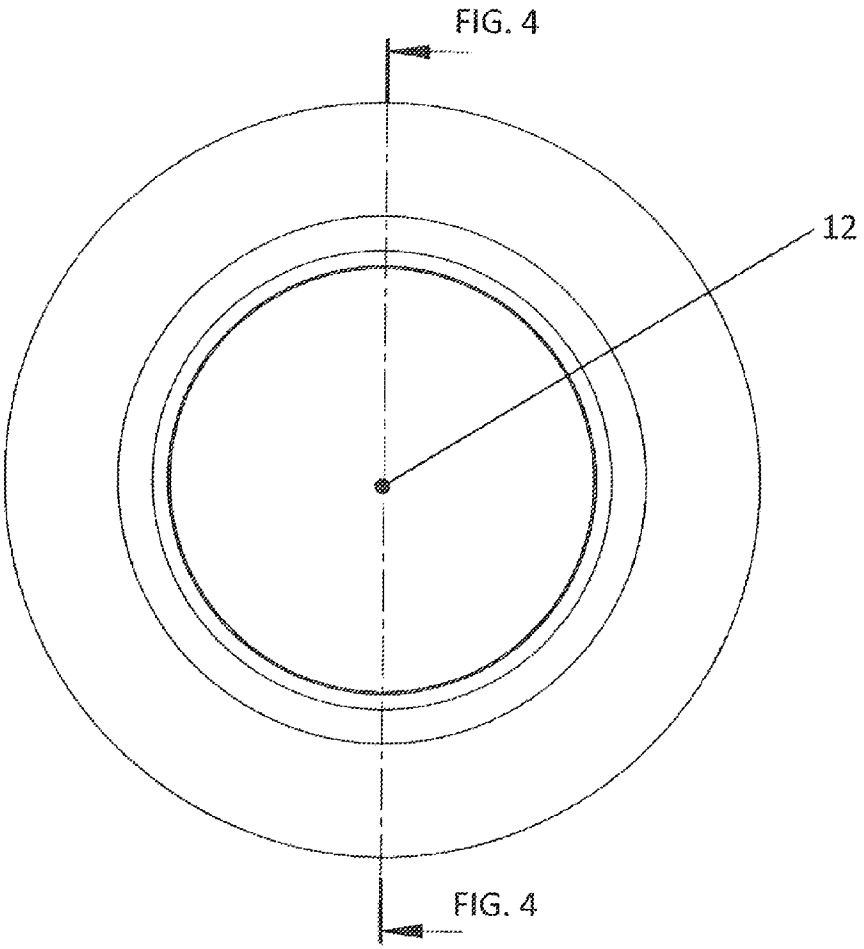
FIG. 3 is an elevation view, looking down the central axis of the assembled ball.

FIG. 3 provides an elevation view looking in a direction that is parallel to the orb ball's central axis. The reader will observe how central passage 12 extends through the orb ball. In addition, the reader will observe that the diameter of the central passage is quite large with respect to the overall diameter of the orb ball.

Figure 4:
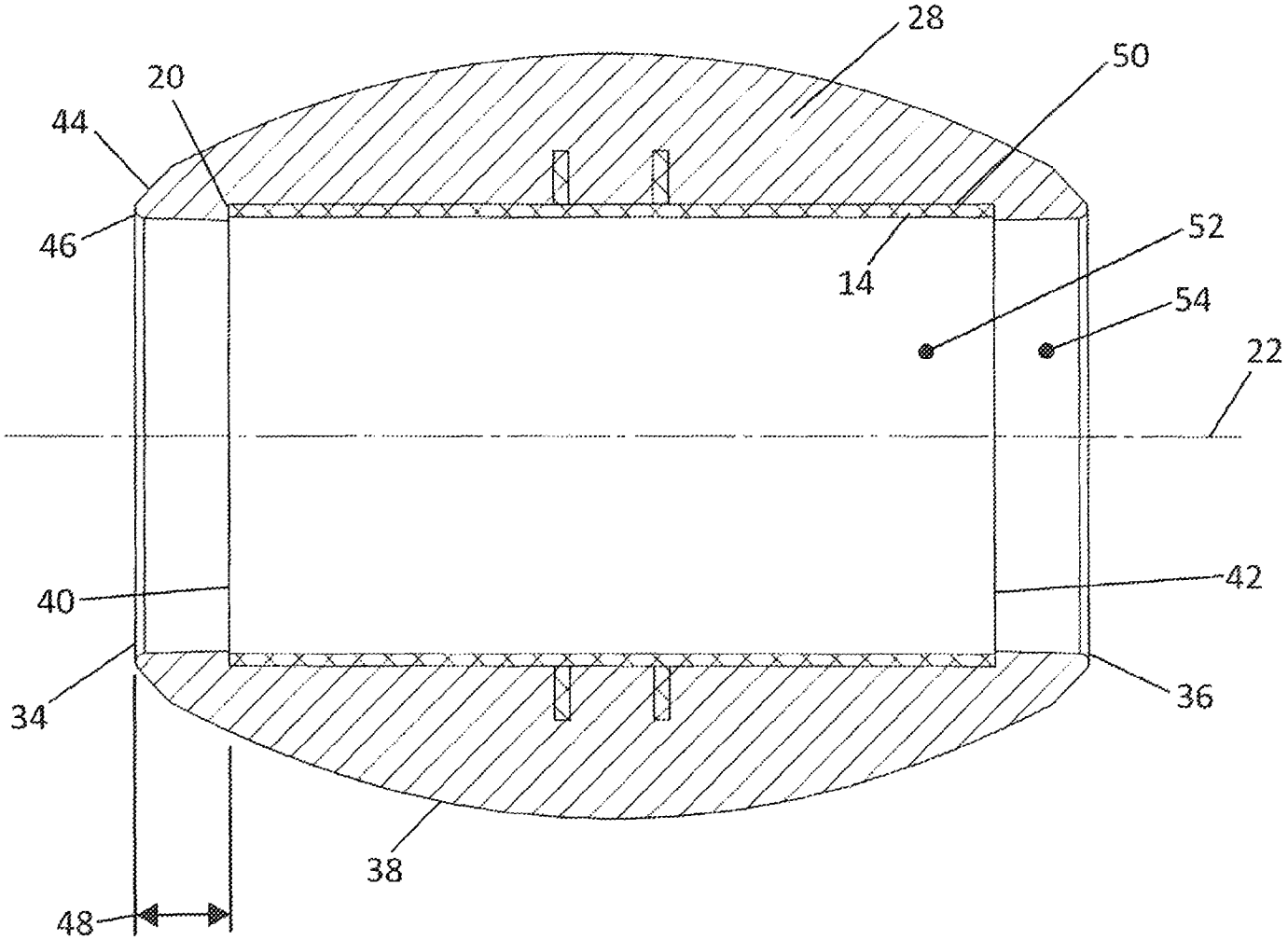
FIG. 4 is a sectional elevation view.

FIG. 4 is a sectional elevation view of the orb ball taken along the central axis. The reader will observe that all the features of the embodiment shown are radially symmetric about central axis 22. As stated previously, insert 14 primarily consists of a cylindrical wall. The cylindrical wall has an inward facing surface and an outward facing surface. The inward facing surface of the cylindrical wall defines insert passage 52.

Foam body 28 includes a cylindrical foam body passage 54. Foam body passage 54 opens into a cylindrical insert recess 50. The insert recess is a cylindrical recess that does not extend for the entire length of the foam body. Instead, it stops at two insert containment steps 20. The first insert containment step abuts first insert end 40 and the second insert containment step abuts second insert end 42. These abutting relationships—along with the ribs on the insert—create a good mechanical interlock between the insert and the foam body.

Surface adhesion between the insert and the foam body may also assist in the creation of the desired interlock. This surface adhesion may be created by a variety of processes, including molding the foam over the insert or the use of a separate spray-on or liquid adhesive.

FIG. 4 serves to illustrate several significant features of the invention. First, the reader will note that exterior profile 38 has a varying diameter. It is intended to resemble the exterior shape of the central portion of an American football. This portion of an American football has an elliptical profile, where the major axis of the defining ellipse is parallel to central axis 22 but also offset from the central axis.

Exterior profile 38 has a maximum diameter in the center of the orb ball. This diameter tapers toward either end of the ball. The diameter of the internal passage remains constant (or nearly so). Foam body 28 extends to first end 34 and second end 36. However, in the embodiment shown, the elliptical exterior profile 38 does not extent all the way to the ends of the orb ball. Instead, a chamfer 44 is included proximate first end 34 and second end 36. In addition, a fillet 46 is used to join the extreme end of each chamfer to foam body passage 54.

As shown in FIG. 4, insert 14 does not extend all the way to the two ends of the orb ball. Instead, it stops short. First end 34 of foam body 28 extends well beyond first insert end 40 and second end 36 extends well beyond second insert end 42. This extension creates a compression region 48 on each end of the orb ball. The compression region helps reduce the risk of injury or damage when the orb ball strikes something. The rigidity of the insert maintains the overall shape of the orb ball. However, the portions of the orb ball that may actually strike an external object (the exterior profile and the two ends) remain pliable.

Figure 5:
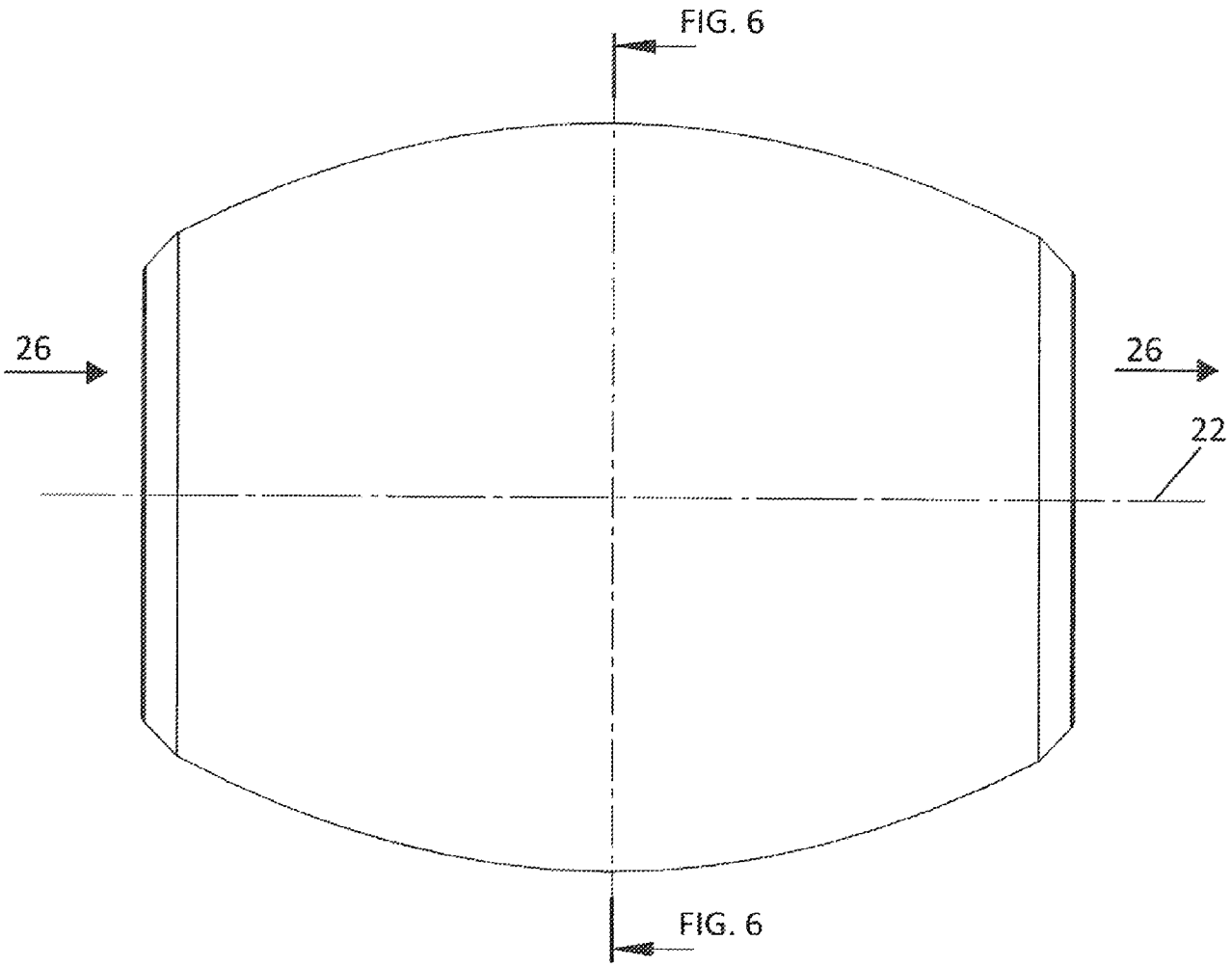
FIG. 5 is an elevation view, showing the inventive ball from the side.

FIG. 5 shows an elevation view of the orb ball looking in a direction that is perpendicular to central axis 22. When the ball is thrown, the central passage allows air flow 26 through the interior of the ball. Air flows over the exterior of the ball in a conventional fashion.

Figure 6:
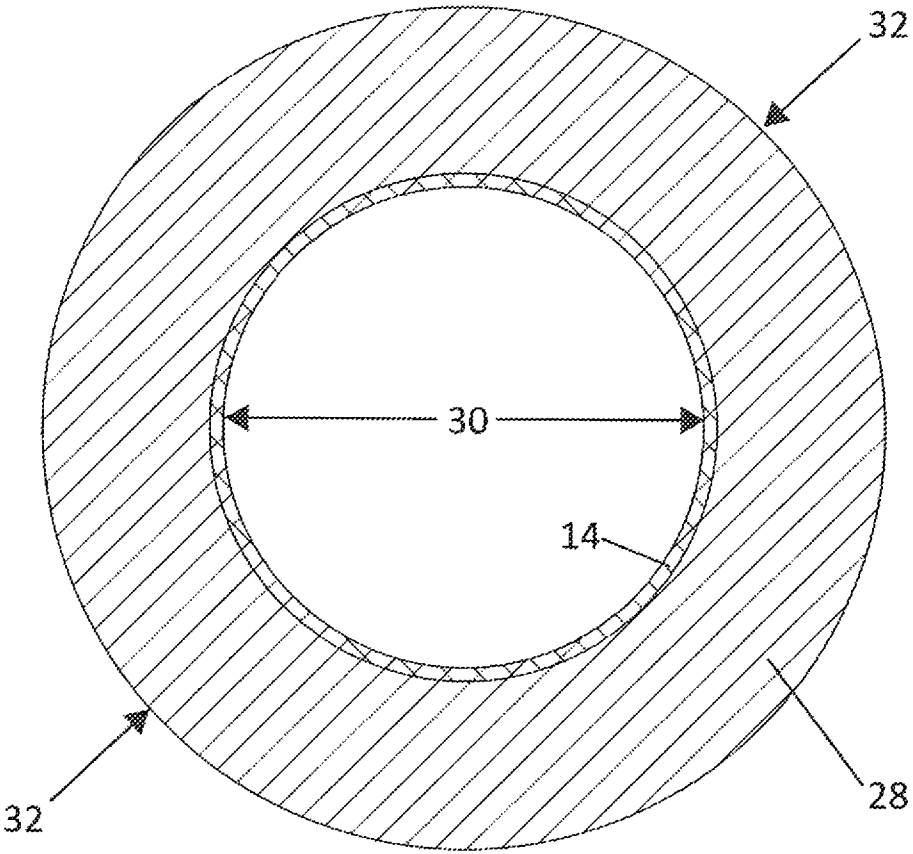
FIG. 6 is a transverse elevation view, illustrating the diameter of the central passage in comparison to the ball as a whole.

FIG. 6 shows a sectional elevation view through the "fattest" portion of the orb ball—taken in a direction that is transverse to the central axis. Passage diameter 30 is shown, as is overall diameter 32. In the preferred embodiment, passage diameter 30 is greater than half the value of overall diameter 32. In an even more preferred embodiment, the passage diameter is greater than 55% of the overall diameter.

Those skilled in the art will understand the principles of angular momentum. In viewing FIG. 6, the reader will note that most of the orb ball's mass is concentrated near its perimeter rather than along its central axis. This fact provides greater spin-stability for a given overall mass.

Looking back at FIG. 4, those skilled in the art will discern another significant operational feature of the orb ball. As mentioned in the background section, an American football that is launched with an eccentric rotation (the ball's central axis being misaligned with the direction of flight) will tend to become less stable in flight. The orb ball's configuration produces the opposite result.

When the orb ball is thrown, air flows through its central passage with considerable velocity. The central passage acts like a wind sock, in that it will always tend to align itself with the prevailing flow. The prevailing flow is of course determined by the direction of the orb ball's flight. Thus, the flow through the central passage acts like a yaw damper for an imperfect throw. The term "imperfect throw" may apply to several conditions including: (1) The ball's axis of rotation is angularly offset from central axis 22, (2) The ball's central axis is misaligned with the direction of flight, and (3) combinations thereof.

For any of these conditions the flow of air through the orb ball's central passage will tend to damp the error. In other words, the flow through the central passage will tend to (1) Shift the ball's axis of rotation so that it lies on the central axis, and (2) Align the central axis with the direction of flight. These stabilizing forces tend to reduce drag and increase the range of a particular throw. A further drag reduction results from the fact that the central passage reduces the orb ball's projected frontal area.

Still looking at FIG. 4, the reader may wish to know some of the manufacturing processes that can be used to create preferred embodiments of the invention. Injection molding may be used to create insert 14. The insert may be molded as a solid body or may be "foam molded"—meaning that gas bubbles are injected into the liquid thermoplastic to create a rigid cellular structure. This technique creates a strong and light structure reminiscent of animal bone in that it has a solid exterior but a porous interior.

Foam body 28 may be created using an overmolding process. In overmolding, the completed insert is placed into a larger mold cavity. A liquid foam molding agent is then added to the cavity. The foam molding agent transitions to a solid while still in the mold. The unified assembly is then removed from the mold.

Insert 14 may be made of any desired thermoplastic. It could also be made using a thermoset material or a cross-linking material. For that matter, insert 14 could even be made of a metal such as aluminum.

Foam body 28 is preferably made from a high-density compressible foam. A suitable foam has a density in the range of 20 kilograms per cubic meter up to 60 kilograms per cubic meter. An even more preferable range lies between 30 kilograms per cubic meter and 50 kilograms per cubic meter. A foam's density is largely dependent upon the cell site in comparison to the cell wall thickness. A variety of techniques can be used to determine this value in order to bring the foam into the desired range of density. A wide variety of foams could be used. Examples include HDPE (high-density polyethylene) and polyurethane foams.

Overmolding tends to produce a good surface bond between the insert and the foam body. The assembly may be created in other ways, however. For example, the foam body could be separately molded and then connected to the insert. The foam body is quite pliable so the insert could be slipped into the interior and snapped into position. A separate adhesive could also be used to facilitate the surface bond.

Although the preceding description contains significant detail, it should not be construed as limiting the scope of the invention but rather as providing illustrations of the preferred embodiments of the invention. One skilled in the art may easily devise variations on the embodiments described. Thus, the scope of the invention should be fixed by the claims rather than the examples given.

Having described our invention, we claim:

1. A throwable ball, comprising:
a. a central axis;
b. an insert, including,
i. a cylindrical wall centered on said central axis, said cylindrical wall having an inward facing surface and an outward facing surface,
ii. said inward facing surface of said cylindrical wall defining an insert passage through said rigid insert,
iii. at least one rib extending outward from said outward facing surface of said cylindrical wall in a non-parallel direction with respect to said central axis,
iv. said insert having a first insert end and a second insert end;
c. a foam body surrounding said insert and centered on said central axis, including,
i. an inward facing cylindrical surface,
ii. an outward facing surface bounded by an exterior profile revolved around said central axis,
iii. said inward facing cylindrical surface of said foam body opening into an insert recess having a first insert containment step and a second insert containment step,
iv. said insert recess receiving said outward facing surface of said cylindrical wall of said insert,
v. said first containment step abutting said first insert end,
vi. said second containment step abutting said second insert end,
vii. said inward facing cylindrical surface of said foam body defining a foam body passage through said foam body,
viii. wherein said foam body passage has the same diameter as said insert passage,
ix. said foam body having a first end offset from said first insert end by a first compression region, and
x. said foam body having a second end offset from said second insert end by a second compression region.

2. A throwable ball as recited in claim 1, further comprising:
a. said outward facing surface of said foam body including a first chamfer proximate said first end; and
b. said outward facing surface of said foam body including a second chamfer proximate said second end.

3. A throwable ball as recited in claim 1, wherein:
a. said foam body passage and said insert passage has a first diameter;
b. said outward facing surface of said foam body has a maximum second diameter; and
c. said first diameter is at least half of said maximum second diameter.

4. A throwable ball as recited in claim 1, wherein said foam body is made of a foam having a density between 20 kilograms per cubic meter and 60 kilograms per cubic meter.

5. A throwable ball as recited in claim 1, wherein at least a portion of said exterior profile of said foam body is defined by an ellipse having a major axis that is parallel to said central axis.

6. A throwable ball as recited in claim 3, further comprising:
a. said outward facing surface of said foam body including a first chamfer proximate said first end; and
b. said outward facing surface Of said foam body including a second chamfer proximate said second end.

7. A throwable ball as recited in claim 4, further comprising:
a. said outward facing surface of said foam body including a first chamfer proximate said first end; and
b. said outward facing surface of said foam body including a second chamfer proximate said second end.

8. A throwable ball as recited in claim 5, further comprising:
a. said outward facing surface of said foam body including a first chamfer proximate said first end; and
b. said outward facing surface of said foam body including a second chamfer proximate said second end.

9. A throwable bail as recited in claim 4, wherein:
a. said foam body passage and said insert passage has a first diameter;
b. said outward facing surface of said foam body has a maximum second diameter; and
c. said first diameter is at least half of said maximum second diameter.

10. A throwable ball as recited in claim 5, wherein:
a. said foam body passage and said insert passage has a first diameter;
b. said outward facing surface of said foam body has a maximum second diameter; and
c. said first diameter is at least half of said maximum second diameter.

11. A throwable ball, comprising:
a. a central
b. an insert, including,
i. a cylindrical wall centered on said central axis, said cylindrical wall defining an insert passage,
ii. at least one interlocking feature extending outward from said cylindrical wall in a non-parallel direction with respect to said central axis,
iii. said insert having a first insert end and a second insert end;
c. a foam body surrounding said insert and centered on said central axis, including,
i. an inward facing cylindrical surface,
ii. an outward facing surface bounded by an exterior profile revolved around said central axis,
iii. said inward facing cylindrical surface of said foam body opening into an insert recess having a first insert containment step and a second insert containment step,
iv. said insert recess receiving said cylindrical wall of said insert,
v. said first containment step abutting said first insert end,
vi. said second containment step abutting said second insert end,
vii. said inward facing cylindrical surface of said foam body defining a foam body passage through said foam body,
viii. wherein said foam body passage has the same diameter as said insert passage,
ix. said foam body having a first end offset from said first insert end by a first compression region, and
x. said foam body having a second end offset from said second insert end by a second compression region.

12. A throwable ball as recited in claim 11, further comprising:
a. said outward facing surface of said foam body including a first chamfer proximate said first end; and
b. said outward facing surface of said foam body including a second chamfer proximate said second end.

13. A throwable ball as recited in claim 11, wherein:
a. said foam body passage and said insert passage has a first diameter;

b. said outward facing surface of said foam body has a maximum second diameter; and c. said first diameter is at least half of said maximum second diameter.

14. A throwable ball as recited in claim 11, wherein said foam body is made of a foam having a density between 20 kilograms per cubic meter and 60 kilograms per cubic meter.

15. A throwable ball as recited in claim 11, wherein at least a portion of said exterior profile of said foam body is defined by an ellipse having a major axis that is parallel to said central axis.

16. A throwable ball as recited in claim 13, further comprising:

a. said outward facing surface of said foam body including a first chamfer proximate said first end; and b. said outward facing surface of said foam body including a second chamfer proximate said second end.

17. A throwable ball as recited in claim 14. further comprising;

a. said outward facing surface of said foam body including a first chamfer proximate said first end; and b. said outward facing surface of said foam body including a second chamfer proximate said second end.

18. A throwable ball as recited in claim 15, further comprising;

a. said outward facing surface of said foam body including a first chamfer proximate said first end; and b. said outward facing surface of said foam body including a second chamfer proximate said second end.

19. A throwable ball as recited in claim 14, wherein:

a. said foam body passage and said insert passage has a first diameter;

b. said outward facing surface of said foam body has a maximum second diameter; and c. said first diameter is at least half of said maximum second diameter.

20. A throwable ball as recited in claim 15, wherein:

a. said foam body passage and said insert passage has a first diameter;

b. said outward facing surface of said foam body has a maximum second diameter; and c. said first diameter is at least half of said maximum second diameter.

* * * * *